US010197033B2

(12) United States Patent
Bayer et al.

(10) Patent No.: US 10,197,033 B2
(45) Date of Patent: Feb. 5, 2019

(54) FUEL-INJECTION DEVICE

(71) Applicant: Robert Bosch GmbH, Stuttgart (DE)

(72) Inventors: Johann Bayer, Bamberg (DE); Wilhelm Reinhardt, Oetisheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/535,307

(22) PCT Filed: Oct. 26, 2015

(86) PCT No.: PCT/EP2015/074702

§ 371 (c)(1),
(2) Date: Jun. 12, 2017

(87) PCT Pub. No.: WO2016/096204

PCT Pub. Date: Jun. 23, 2016

(65) Prior Publication Data

US 2017/0350358 A1 Dec. 7, 2017

(30) Foreign Application Priority Data

Dec. 16, 2014 (DE) ..... 10 2014 225 976

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/858* (2013.01)

(58) Field of Classification Search
CPC .. F02M 61/14; F02M 53/046; F02M 2200/03; F02M 2200/09; F02M 2200/858
See application file for complete search history.

(56) References Cited

U.S. PATENT DOCUMENTS 6,009,856 A 1/2000 Smith, III et al.
2003/0145832 A1* 8/2003 Reiter ..... F02M 61/14 123/470

(Continued)

FOREIGN PATENT DOCUMENTS

DE 19807819 C1 5/1999
DE 10027662 A1 12/2001

(Continued)

OTHER PUBLICATIONS

International Search Report dated Jan. 4, 2016, of the corresponding International Application PCT/EP2015/074702 filed Oct. 26, 2015.

*Primary Examiner* — Hieu T Vo
*Assistant Examiner* — Arnold Castro
(74) *Attorney, Agent, or Firm* — Norton Rose Fulbright US LLP; Gerard Messina

(57) ABSTRACT

A fuel-injection device has a low-noise and pivotable structure. The fuel-injection device includes at least a fuel injector and a receiving bore in a cylinder head for the fuel-injector, and a decoupling element between a valve housing of the fuel injector and a wall of the receiving bore. The decoupling element is captively situated on the fuel injector prior to its installation in the receiving bore in that a securing ring is mounted below the decoupling element at the outer periphery of the fuel injector and the securing ring is a closed plastic ring. The fuel-injection device is particularly suited for the direct injection of fuel into a combustion chamber of a mixture-compressing internal combustion engine having externally supplied ignition.

17 Claims, 6 Drawing Sheets

(56) References Cited

U.S. PATENT DOCUMENTS

| | | | | |
|---|---|---|---|---|
| 2004/0089270 | A1* | 5/2004 | Scheffel | F02M 61/14<br>123/470 |
| 2007/0175451 | A1* | 8/2007 | Beardmore | F02M 61/14<br>123/470 |
| 2010/0006060 | A1* | 1/2010 | Hoefner | F02M 61/14<br>123/294 |
| 2010/0018502 | A1* | 1/2010 | Fischetti | F02M 61/14<br>123/470 |
| 2011/0000464 | A1* | 1/2011 | Kannan | F02M 55/004<br>123/470 |
| 2011/0132329 | A1* | 6/2011 | Hofmann | F02M 61/14<br>123/470 |
| 2011/0265767 | A1* | 11/2011 | Xu | F02M 53/046<br>123/470 |
| 2011/0303192 | A1* | 12/2011 | Jung | F02M 61/14<br>123/445 |

FOREIGN PATENT DOCUMENTS

| | | | |
|---|---|---|---|
| DE | 10038763 | A1 | 2/2002 |
| DE | 10108466 | A1 | 9/2002 |
| DE | 10338094 | A1 | 5/2005 |
| DE | 102004060983 | A1 | 6/2006 |
| DE | 102011089295 | A1 | 6/2013 |
| EP | 1223337 | A1 | 7/2002 |
| JP | 2006283831 | A | 10/2006 |
| JP | 2010127193 | A | 6/2010 |
| WO | 2010015454 | A1 | 2/2010 |
| WO | 2014/079609 | A1 | 5/2014 |

* cited by examiner

FUEL-INJECTION DEVICE

FIELD

The present invention is based on a fuel-injection device.

BACKGROUND INFORMATION

FIG. 1 shows a conventional fuel-injection device by way of example. Here, a flat intermediate element is provided on a fuel-injection valve installed in a receiving bore of a cylinder head of an internal combustion engine. In the known manner, such intermediate elements are placed as support elements in the form of washers on a shoulder of the receiving bore of the cylinder head. Intermediate elements of this kind are meant to compensate for production and installation tolerances and to ensure that transverse forces will not affect the mounting even when the fuel injector is positioned at a slight tilt. The fuel-injection device is especially suitable for use in fuel-injection systems of mixture-compressing internal combustion engines having externally supplied ignition.

Another type of simple intermediate element for a fuel-injection device is described in German Patent Application No. DE 101 08 466 A1. The intermediate element is a washer having a circular cross-section, which is disposed in a region in which both the fuel injector and the wall of the receiving bore in the cylinder head extend in the form of a truncated cone, and which is used as a compensating element for mounting and supporting the fuel injector.

Intermediate elements for fuel-injection devices that are more complicated and much more resource-intensive in the production are also described in German Patent Applications DE 100 27 662 A1 and DE 100 38 763 A1, and European Patent No. EP 1 223 337 A1, among others. All of these intermediate elements are characterized by being constructed of multiple parts and/or multiple layers and are meant to assume sealing and damping functions in some cases. The intermediate element described in German Patent Application No. DE 100 27 662 A1 includes a base element and carrier body, into which a sealing means that is penetrated by a nozzle body of the fuel injector is inserted. German Patent Application No. DE 100 38 763 A1 describes a multi-layered compensating element which is composed of two rigid rings and an elastic intermediate ring sandwiched between them. This compensating element allows both for tilting of the fuel injector in relation to the axis of the receiving bore over a relatively large angular range and a radial displacement of the fuel injector from the center axis of the receiving bore.

An intermediate element that likewise has multiple layers is also described in European Patent No. EP 1 223 337 A1; this intermediate element is composed of a plurality of washers which are made from a damping material. The damping material of metal, rubber or PTFE is selected and configured so that noise damping of the vibrations and noise generated by the operation of the fuel injector is possible. However, the intermediate element must have four to six layers for this purpose in order to achieve the desired damping effect.

Furthermore, to reduce noise emissions, U.S. Pat. No. 6,009,856 A describes to surround the fuel injector by a sleeve and to fill up the created interspace with an elastic, noise-damping mass. However, this type of noise damping is very resource-intensive, difficult to assemble and costly.

SUMMARY

An example fuel-injection device according to the present invention may have the advantage that a loss prevention set-up for the decoupling element is able to be mounted on the fuel injector in a very simple and cost-effective manner; this prevents the decoupling element from sliding prior to the installation of the fuel injector in the receiving bore. According to the present invention, the loss prevention is assumed by a compact, solid and yet filigree securing ring, which is disposed below the decoupling element at the outer periphery of the fuel injector.

Despite its very simple and easily producible geometry and contouring, the securing ring is characterized by an especially high functional integration because functional regions that project in different directions are developed on the securing ring, which constitutes a solid component, the functional regions being used for holding, securing, centering, pre-positioning and for inserting and mounting without causing any damage.

Advantageous further refinements and improvements of the fuel-injection device are possible by the measures described herein.

The decoupling element is characterized by low height, which allows for its usage in small spaces as well. In addition, the decoupling element has considerable dynamic strength even at high temperatures. The decoupling element is able to be produced in a very simple and cost-effective manner from the manufacturing point of view. The entire suspension of the system made up of the fuel injector and decoupling element may furthermore be easily and rapidly assembled and disassembled.

BRIEF DESCRIPTION OF THE DRAWINGS

Exemplary embodiments of the present invention are shown in simplified form in the figures and described in greater detail below.

DETAILED DESCRIPTION OF EXAMPLE EMBODIMENTS

Figure 1:
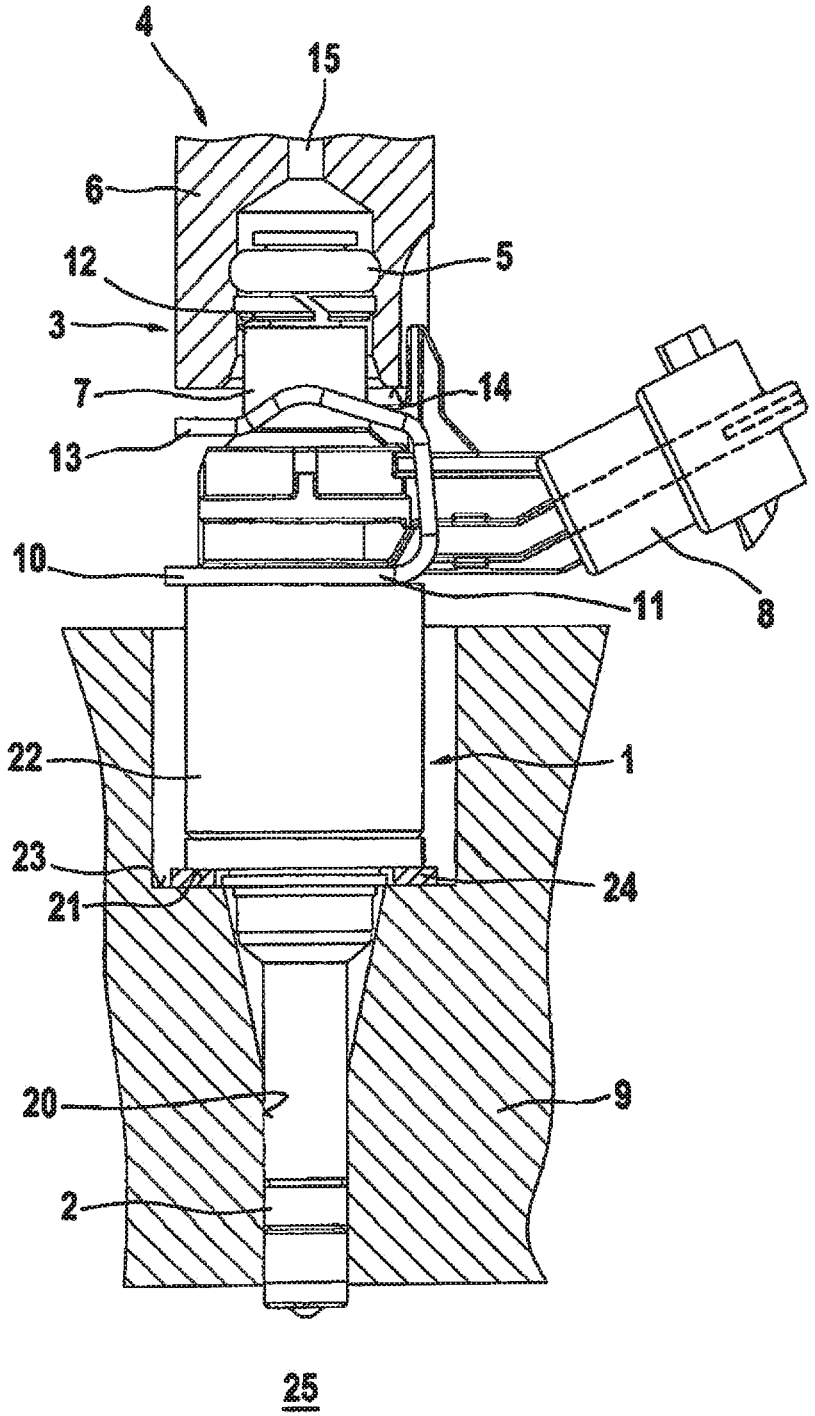
FIG. 1 shows a partially depicted fuel-injection device in a known embodiment including a disk-shaped intermediate element.

For an understanding of the present invention, a conventional specific embodiment of a fuel-injection device is described in greater detail in the following text on the basis of FIG. 1. FIG. 1 shows a valve in the form of an injector 1 for fuel-injection systems of mixture-compressing internal combustion engines having externally supplied ignition, as an exemplary embodiment in a side view. Fuel injector 1 is part of the fuel-injection device. By a downstream end, fuel injector 1, which is implemented in the form of a directly injecting injector for the direct injection of fuel into a combustion chamber 25 of the internal combustion engine, is installed in a receiving bore 20 of a cylinder head 9. A sealing ring 2, in particular made from Teflon®, provides optimum sealing of fuel injector 1 from the wall of receiving bore 20 of cylinder head 9.

A flat intermediate element 24, which is implemented as a bracing element in the form of a washer, is inserted between a step 21 of a valve housing 22 and a shoulder 23, which extends at a right angle to the longitudinal extension of receiving bore 20, for instance. Such an intermediate element 24 makes it possible to compensate for production and installation tolerances and ensures support without transverse forces being exerted even if fuel injector 1 is positioned at a slight tilt.

At its inlet-side end 3, fuel injector 1 has a plug-in connection to a fuel distributor line (fuel rail) 4 that is sealed by a sealing ring 5 between a connecting pipe 6, shown in a sectional view, of fuel-distributor line 4 and an inlet tube 7 of fuel injector 1. Fuel injector 1 is slipped into a receiving bore 12 of connecting pipe 6 of fuel-distributor line 4. Connecting pipe 6, for example, emerges from actual fuel-distributor line 4 in one piece; upstream from receiving bore 12, it has a flow opening 15 of a smaller diameter, via which the oncoming flow approaches fuel injector 1. Fuel injector 1 is provided with an electrical plug connector 8 for the electrical contacting for the actuation of fuel injector 1.

A hold-down device 10 is provided between fuel injector 1 and connecting pipe 6 in order to set fuel injector 1 and fuel-distributor line 4 apart from each other largely without radial forces being exerted, and to hold fuel injector 1 down securely in the receiving bore of the cylinder head. Hold-down device 10 is implemented as a bow-shaped component such as a stamped and bent part. Hold-down device 10 has a base element 11 in the form of a partial ring, from which a hold-down clamp 13 that rests against a downstream end region 14 of connecting pipe 6 on fuel-distributor line 4 in the installed state, extends at an angle.

In comparison with the conventional intermediate-element solutions, the present invention firstly obtains better noise damping in an uncomplicated manner, above all in the noise-critical idling operation, with the aid of a selective configuration and geometry of intermediate element 24. Secondly, a simple and cost-effective tolerance compensation that allows for tilting of the fuel injector by up to 1° is to be possible and also an operation without the occurrence of transverse forces under thermal influences. The relevant noise source of fuel injector 1 in the direct high-pressure injection is the forces (structure-borne noise) introduced into cylinder head 9 during the valve operation; these forces lead to a structural excitation of cylinder head 9 and are radiated by cylinder head 9 in the form of airborne sound. To obtain a noise improvement, it is therefore desirable to minimize the forces introduced into cylinder head 9. In addition to reducing the forces induced by the injection, this minimization may be achieved by influencing the transmission behavior between fuel injector 1 and cylinder head 9.

Figure 2:
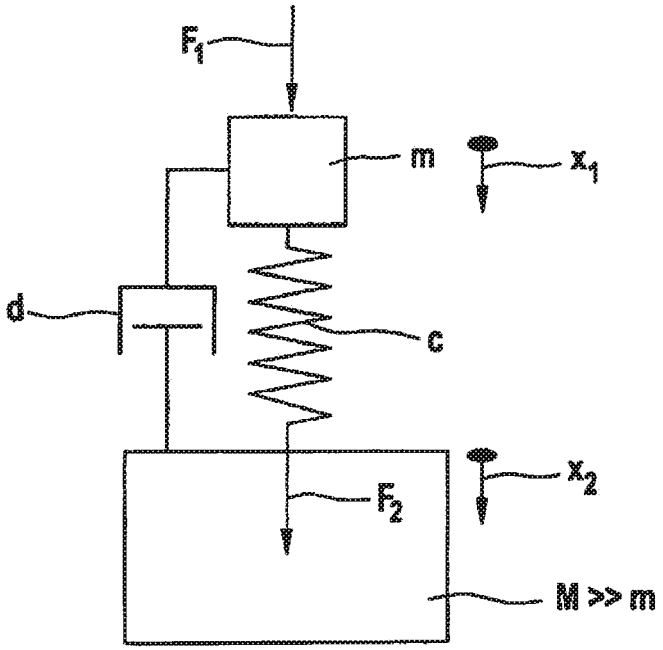
FIG. 2 shows a mechanical equivalent circuit diagram of the bracing of the fuel injector in the cylinder head during the direct injection of fuel, which represents a conventional spring mass damper system.
Figure 3:
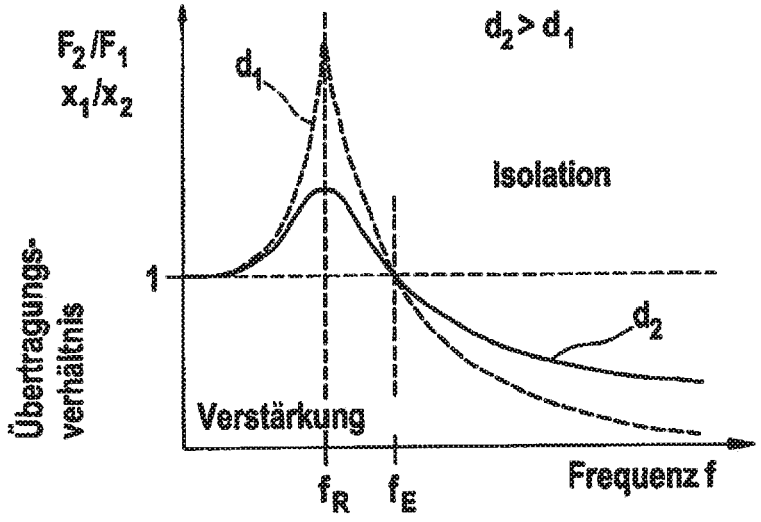
FIG. 3 shows the transmission behavior of a spring mass damper system shown in FIG. 2 featuring an amplification at low frequencies in the range of resonant frequency $f_R$ and an insulation range above decoupling frequency $f_E$.

In the mechanical sense, the seating of fuel injector 1 on passive intermediate element 24 in receiving bore 20 of cylinder head 9 may be reproduced as a conventional spring mass damper system, as illustrated in FIG. 2. Mass M of cylinder head 9 in comparison with mass m of fuel injector 1 may be assumed as infinitely large in the first approximation. The transmission behavior of such a system is characterized by an amplification at low frequencies in the range of resonant frequency $f_R$ and an isolation range above decoupling frequency $f_E$ (see FIG. 3).

The decoupling of fuel injector 1 from cylinder head 9 with the aid of a low spring stiffness c of decoupling element 25, which is implemented in the form of a ring, especially a closed ring, and which features a cushion-type design in cross-section, is made more difficult not only by the small space but also by a restriction of the permissible axial maximum movement of fuel injector 1 during the engine operation. Typically, the following quasi-static load states are encountered in the vehicle:

1. static hold-down force $F_{NH}$ applied by a hold-down device 10 following the installation;
2. force $F_L$ acting at an idling operating pressure; and
3. force $F_{Sys}$ present at a nominal system pressure.

In order to be able to implement the noise-decoupling measures in an uncomplicated and cost-effective manner under typical marginal conditions of the direct injection of fuel (limited space, great forces, low axial overall movement of fuel injector 1), decoupling element 25 with its cushion-type cross-section is furthermore configured across its annular extension in such a way that a lower, e.g., largely planar, end face 26 is provided, which sits on a shoulder 23 of receiving bore 20 in cylinder head 9; in addition, an upper end face 27 is provided, which increases conically from radially outside to radially inside and is in intimate contact with a spherically curved shoulder area 21 of valve housing 22 of fuel injector 1.

Figure 4:
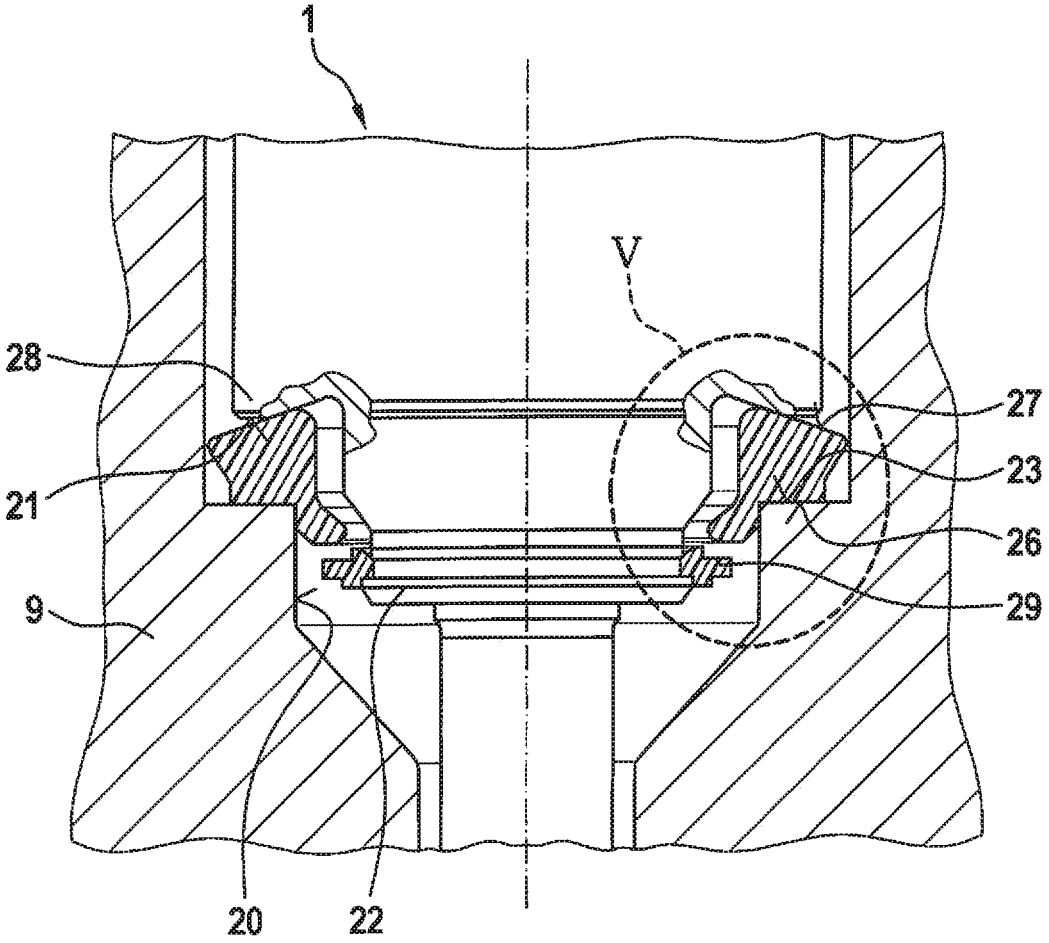
FIG. 4 shows a cross-section through a fuel-injection device according to the present invention in an installation situation on a fuel injector in the region of the disk-shaped intermediate element depicted in FIG. 1.

FIG. 4 shows a cross-section through a decoupling element 25 in an installation position on a fuel injector 1 in the area of disk-shaped intermediate element 24 shown in FIG. 1, intermediate element 24 having been replaced by decoupling element 25.

According to the present invention, decoupling element 25 is captively disposed on fuel injector 1 in that a securing ring 29 is mounted below decoupling element 25 on the outer periphery of fuel injector 1. Securing ring 29 represents a closed plastic ring. Securing ring 29 is characterized by its development as a solid component, which has a small and compact design and includes functional regions that project in different directions. Decoupling element 25 must be fastened to fuel injector 1 so as not to get lost in order to allow a joint installation and de-installation of fuel injector 1 and decoupling element 25 into cylinder head 9 of the internal combustion engine at the original equipment manufacturer (OEM). In this way, the OEM needs to handle only one overall component.

Figure 5:
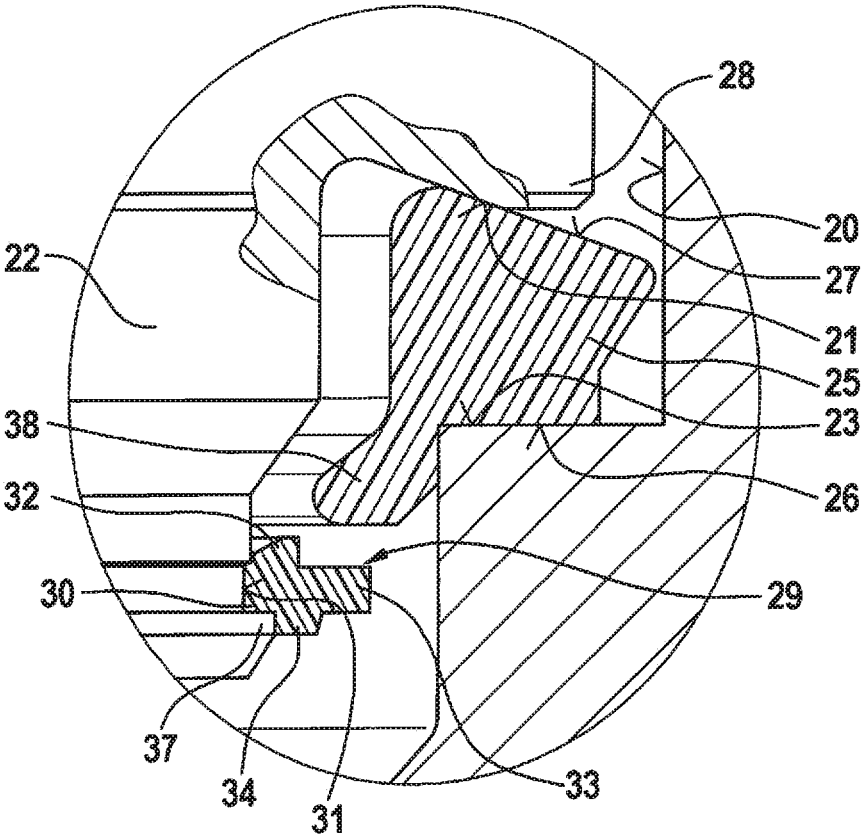
FIG. 5 shows a detail view V of FIG. 4.

In an enlarged detail view, FIG. 5 shows decoupling element 25 and securing ring 29 as a cutaway V of FIG. 4. The functional region positioned radially farthest towards the inside is a holding region 30, which corresponds to a groove 31 introduced on valve housing 22. A slanted region 32, which points in the direction of decoupling element 25 and has a lead-in chamfer that is meant to assume a pre-positioning function, extends starting from holding region 30. The functional region positioned radially farthest towards the outside is a securing region 33, which radially engages with decoupling element 25 from below (at an axial clearance that is small, at least in the installed state) such that sliding of decoupling element 25 from fuel injector 1 prior to its installation in receiving bore 20 is impossible. A functional region projecting towards below is a centering region 34, which is developed as a type of annular collar and rests against valve housing 22 with a clearance fit.

According to the present invention, securing ring 29 is designed to be compact, and its outer dimensions are such that no contact will be established between the wall of receiving bore 20 of cylinder head 9 and securing ring 29 in the event of a deflection/tilting of fuel injector 1. This would again lead to the introduction of transverse forces into fuel injector 1 and thus to undesired bending. In addition, secure retaining of securing ring 29 on fuel injector 1 would no longer be ensured across the entire service life.

Securing ring 29 is made of plastic and is conditioned prior to its installation on fuel injector 1. In the process, the plastic is selectively enriched, for instance with water, for expansion purposes. This increases its elasticity without tears or the like occurring in the plastic structure. Afterwards, securing ring 29 is stretched over a collar 37 on valve housing 22. Because of the specially conditioned state, securing ring 29 is able to tolerate the stress created in the process. In order to be able to carry out the installation process in a secure and reliable manner, fuel injector 1 has on its collar 37 a lead-in chamfer of 30°, for example. A short, cylindrical section on collar 37 provided above the lead-in chamfer helps to reliably prevent securing ring 29 from upending itself during the installation. To allow a radial pre-positioning of securing ring 29, the securing ring is provided with slanted region 32, which has a lead-in chamfer of 45°, for example. Groove 31 introduced in valve housing 22 ensures that holding region 30 that follows slanted region 32 will be caught, thereby preventing that no contact or full contact exists at decoupling element 25 in the installed state. This would otherwise restrict the pivoting ability of fuel injector 1 to a considerable extent. In the installed state, securing ring 29 is positioned in groove 31 under compression, i.e. the maximum inner diameter of securing ring 29 is smaller than the minimum outer diameter of the groove base on valve housing 22. Following the installation of the unit, made up of fuel injector 1/decoupling element 25/securing ring 29, in receiving bore 20, the plastic will reduce its moisture content back to the original extent again, so that the interference fit on fuel injector 1 is increased even further.

In the exemplary embodiment shown, decoupling element 25 has on its topside the conically or coniformly extending end face 27, which in the installed state corresponds with the rounded or spherically implemented, convexly rounded shoulder area 21 of valve housing 22 of fuel injector 1. Shoulder area 21 of valve housing 22 is developed on a radially outwardly positioned shoulder 28. Shoulder area 21 of valve housing 22 need not have a spherically curved form throughout; it is sufficient if such a shape is provided in the contact region with the conically extending end face 27 of decoupling element 25. The respective transitions of upper end face 27 and lower end face 26 with regard to the two inner and outer annular lateral areas of decoupling element 25 may be rounded. The geometry with a flat angle or a large radius of the curvature at spherically curved shoulder area 21 of valve housing 22, and conically or coniformly extending end face 27 of decoupling element 25, in conjunction with a relatively large play radially inwardly in the direction of fuel injector 1 and with little play radially outwardly in the direction of the wall of receiving bore 20, allows for the use of an injectable plastic element or a cold-shaped aluminum element. Such a decoupling element 25 is able to be produced in a cost-effective manner and decouples the structure-borne noise in the desired manner.

Jointly with the slightly convexly shaped shoulder area 21 of valve housing 22, a pivotable or tiltable connection is created for the compensation of tolerances. In case of an offset between fuel injector 1 and receiving bore 20 within the framework of the tolerated production fluctuations, slight tilting of fuel injector 1 may occur. Because of the pivotable connection between fuel injector 1 and decoupling element 25, transverse forces in a tilted position of fuel injector 1 are then largely avoided. A collar 38 on decoupling element 25, the collar having a slanted design and projecting beyond shoulder 23 of receiving bore 20 in the direction of securing ring 29, may be used for an even more optimal stabilization of decoupling element 25 in the event of tilting and allows for a very compact design of securing ring 29 inasmuch as decoupling element 25 is already securely gripped from below in the region of collar 38 at low radial dimensions of securing ring 29.

Figure 6:
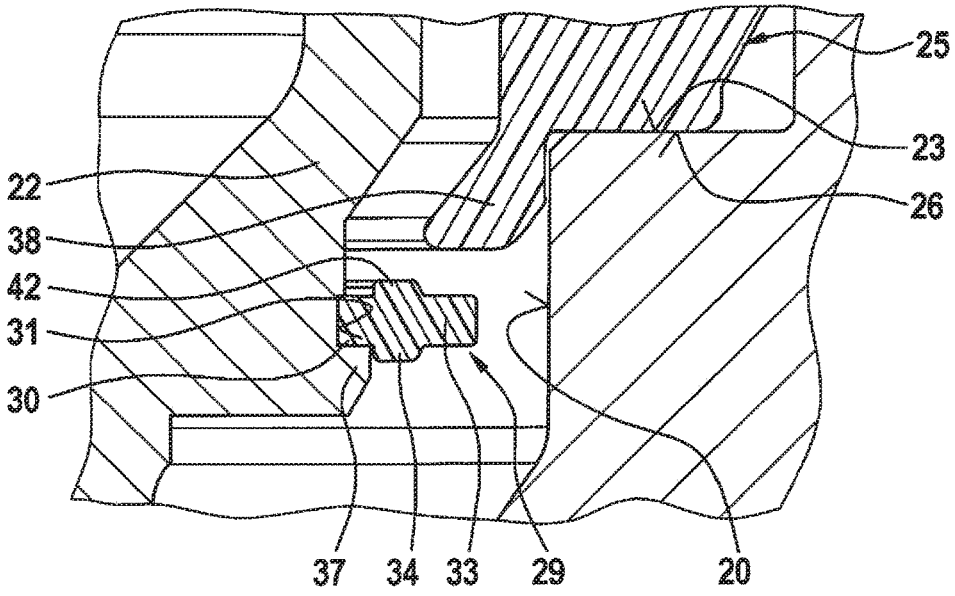
FIGS. 6 and 7 show an alternative embodiment of a securing ring according to the present invention, FIG. 6 showing the installation situation in a view analogous to FIG. 5, and FIG. 7 showing the securing ring as an individual component in an oblique plan view.
Figure 7:
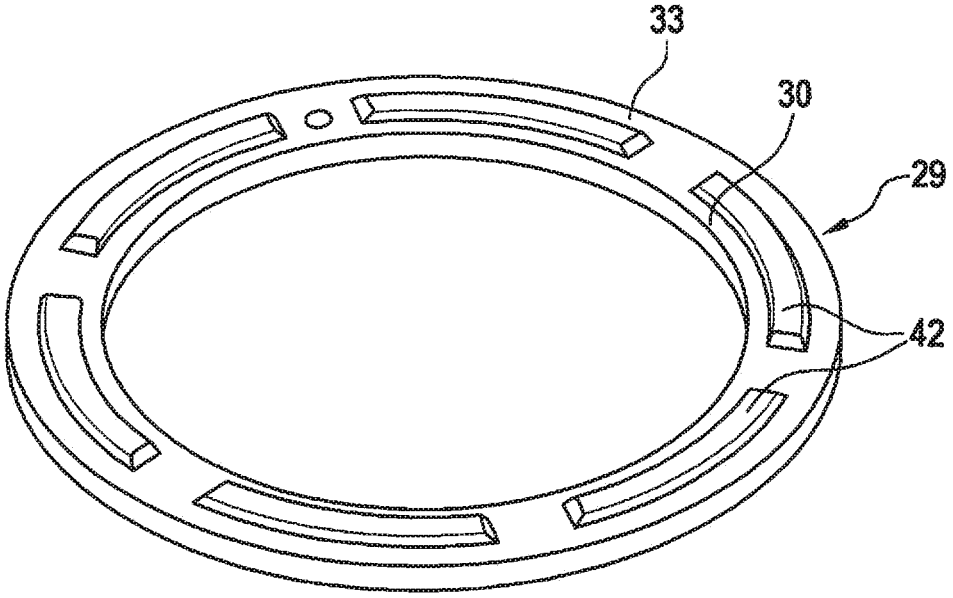

An alternative design of a securing ring 29 according to the present invention is shown in FIGS. 6 and 7, FIG. 6 showing the installation position and FIG. 7 showing securing ring 29 as an individual component in an oblique plan view. This development of securing ring 29, too, represents a compact, solid and closed plastic ring. This variant of securing ring 29 advantageously offers the option of a non-directional installation at the production facility of fuel injector 1. In the development shown in FIGS. 4 and 5, securing ring 29 must be supplied to the assembly line in directional form because of its pre-positioning chamfer developed in the form of a slanted region 32, and may thus have a certain fault susceptibility.

Securing ring 29 has a quasi-symmetrical design on its topside and underside. As a result, it does not matter in which position securing ring 29 is installed on fuel injector 1. With regard to the installation and function, it exhibits a similar behavior in both installation directions. Similar to annular collar-type centering region 34 of the first exemplary embodiment, web areas 42 in the form of ring sections project from the base body of securing ring 29 in the upward and downward directions, of which six, for example, are developed at a distance from one another across the entire ring. On the topside and underside, securing ring 29 has an only quasi-symmetrical design because interrupted web areas 42, which have a slightly trapezoidal cross section, are situated at an offset of 30°, for instance, so that gaps between web areas 42 on the one side are always situated opposite from web areas 42 on the other side. Such a development has advantages both from the aspect of durability and injection-molding technology.

What is claimed is:

1. A fuel-injection device for a fuel-injection system of an internal combustion engine, for the direct injection of fuel into a combustion chamber of the internal combustion engine, comprising:

at least a fuel injector;

a receiving bore for the fuel injector; and a decoupling element between a valve housing of the fuel injector and a wall of the receiving bore, the decoupling element being captively disposed on the fuel injector in that a securing ring is mounted below the decoupling element at an outer periphery of the fuel injector, and the securing ring is a closed plastic ring;

wherein the securing ring is mounted at an outer circumference of the injector housing.

2. The fuel-injection device as recited in claim 1, wherein the securing ring is a solid component, which has functional regions that project in different directions.

3. The fuel-injection device as recited in claim 2, wherein a functional region positioned radially farthest towards inside of the securing ring is a holding region, which corresponds to a groove introduced on a valve housing of the fuel injector.

4. The fuel-injection device as recited in claim 3, wherein starting from the holding region, a slanted region is provided, which points in a direction of the decoupling element and has a lead-in chamfer for pre-positioning purposes.

5. A fuel-injection device for a fuel-injection system of an internal combustion engine, for the direct injection of fuel into a combustion chamber of the internal combustion engine, comprising:

at least a fuel injector;

a receiving bore for the fuel injector; and a decoupling element between a valve housing of the fuel injector and a wall of the receiving bore, the decoupling element being captively disposed on the fuel injector in that a securing ring is mounted below the decoupling element at an outer periphery of the fuel injector, and the securing ring is a closed plastic ring;

wherein the securing ring is a solid component, which has functional regions that project in different directions, and wherein a functional region of the securing ring positioned radially farthest toward the outside is a securing region, which radially engages with the decoupling element from below to such an extent that sliding of the decoupling element from the fuel injector prior to its installation in the receiving bore is impossible.

6. A fuel-injection device for a fuel-injection system of an internal combustion engine, for the direct injection of fuel into a combustion chamber of the internal combustion engine, comprising:

at least a fuel injector;

a receiving bore for the fuel injector; and a decoupling element between a valve housing of the fuel injector and a wall of the receiving bore, the decoupling element being captively disposed on the fuel injector in that a securing ring is mounted below the decoupling element at an outer periphery of the fuel injector, and the securing ring is a closed plastic ring;

wherein the securing ring is a solid component, which has functional regions that project in different directions, and wherein a functional region of the securing ring projecting toward below is a centering region, which is configured as a type of annular collar.

7. A fuel-injection device for a fuel-injection system of an internal combustion engine, for the direct injection of fuel into a combustion chamber of the internal combustion engine, comprising:

at least a fuel injector;

a receiving bore for the fuel injector; and a decoupling element between a valve housing of the fuel injector and a wall of the receiving bore, the decoupling element being captively disposed on the fuel injector in that a securing ring is mounted below the decoupling element at an outer periphery of the fuel injector, and the securing ring is a closed plastic ring;

wherein the securing ring is a solid component, which has functional regions that project in different directions, and wherein the securing ring has on a topside and an underside a plurality of web areas in the form of ring sections, which are set apart from one another and are formed across the entire ring.

8. The fuel-injection device as recited in claim 7, wherein the web areas in the form of ring sections are at an offset from one another in a projection into a plane, so that gaps between the web areas on one side are situated opposite from web areas on the other side.

9. A fuel-injection device for a fuel-injection system of an internal combustion engine, for the direct injection of fuel into a combustion chamber of the internal combustion engine, comprising:

at least a fuel injector;

a receiving bore for the fuel injector; and a decoupling element between a valve housing of the fuel injector and a wall of the receiving bore, the decoupling element being captively disposed on the fuel injector in that a securing ring is mounted below the decoupling element at an outer periphery of the fuel injector, and the securing ring is a closed plastic ring;

wherein the decoupling element is in the form of a closed ring, which has a lower end face that sits on a shoulder of the receiving bore, and which has an upper end face that increases conically from radially outside to radially inside and is in intimate contact with a spherically curved shoulder area of a valve housing of the fuel injector.

10. The fuel-injection device as recited in claim 9, wherein the decoupling element is one of an injection-molded plastic element, or a cold-formed aluminum element.

11. The fuel-injection device as recited in claim 1, wherein the decoupling element is installed in such a way that a relatively large play is present radially inwardly in a direction of the fuel injector and very low play is present radially outwardly in a direction of the wall of the receiving bore.

12. The fuel-injection device as recited in claim 9, wherein in a region of its upper, conically extending end face, the decoupling element enters into a pivotable or tiltable connection with the fuel injector to compensate for tolerances.

13. The fuel-injection device as recited in claim 1, wherein the receiving bore for the fuel injector is in a cylinder head, and the receiving bore has a shoulder on which the decoupling element sits and which extends perpendicular to an extension of the receiving bore.

14. The fuel-injection device as recited in claim 2, wherein a functional region of the securing ring positioned radially farthest toward the outside is a securing region, which radially engages with the decoupling element from below to such an extent that sliding of the decoupling element from the fuel injector prior to its installation in the receiving bore is impossible.

15. The fuel-injection device as recited in claim 2, wherein a functional region of the securing ring projecting toward below is a centering region, which is configured as a type of annular collar.

16. The fuel-injection device as recited in claim 2, wherein the securing ring has on a topside and an underside a plurality of web areas in the form of ring sections, which are set apart from one another and are formed across the entire ring.

17. The fuel-injection device as recited in claim 1, wherein the decoupling element is in the form of a closed ring, which has a lower end face that sits on a shoulder of the receiving bore, and which has an upper end face that increases conically from radially outside to radially inside and is in intimate contact with a spherically curved shoulder area of a valve housing of the fuel injector.

* * * * *